US008745820B2

(12) United States Patent
Janak

(10) Patent No.: US 8,745,820 B2
(45) Date of Patent: Jun. 10, 2014

(54) ROTARY HINGE WITH ADJUSTABLE DAMPING ASSEMBLY

(75) Inventor: John M. Janak, West Seneca, NY (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 40 days.

(21) Appl. No.: 13/250,268

(22) Filed: Sep. 30, 2011

(65) Prior Publication Data

US 2013/0081228 A1 Apr. 4, 2013

(51) Int. Cl.

| | |
|---|---|
| ***E05F 3/20*** | (2006.01) |
| ***E05F 3/00*** | (2006.01) |
| ***E05F 3/14*** | (2006.01) |

(52) U.S. Cl.

USPC ..... 16/54; 16/50; 188/290

(58) Field of Classification Search

USPC ..... 16/54, 50, 310, 301, 308, 307; 188/290, 188/293, 294, 296

See application file for complete search history.

(56) References Cited

U.S. PATENT DOCUMENTS

| | | | | |
|---|---|---|---|---|
| 511,548 | A | 12/1893 | Rodwell | |
| 1,823,263 | A | 9/1931 | Fabry | |
| 2,434,524 | A * | 1/1948 | Swanson | 16/54 |
| 2,456,537 | A * | 12/1948 | Seaman et al. | 16/54 |
| 2,484,764 | A * | 10/1949 | Swanson | 16/54 |
| 2,490,258 | A * | 12/1949 | Diebel | 16/54 |
| 2,591,476 | A * | 4/1952 | Swanson | 16/54 |
| 2,716,470 | A | 8/1955 | Focht | |
| 2,758,679 | A * | 8/1956 | O'Connor et al. | 188/269 |
| 2,790,520 | A * | 4/1957 | Kuhn, Jr. | 188/307 |
| 2,851,128 | A * | 9/1958 | Kuhn, Jr. | 188/278 |
| 3,018,854 | A | 1/1962 | Gies et al. | |
| 3,316,582 | A | 5/1967 | Johnston et al. | |
| 3,952,365 | A | 4/1976 | Grisebach | |
| 4,068,344 | A * | 1/1978 | Okabe | 16/54 |
| 4,073,038 | A * | 2/1978 | Curry et al. | 16/301 |
| 4,080,687 | A | 3/1978 | Jentsch | |
| 4,411,341 | A | 10/1983 | Schultz | |
| 4,413,373 | A * | 11/1983 | Sasaki | 16/54 |
| 4,485,522 | A | 12/1984 | Chen | |
| 4,674,608 | A | 6/1987 | Morris et al. | |
| 4,697,302 | A | 10/1987 | Yuenian | |
| 4,756,051 | A * | 7/1988 | Shy | 16/50 |
| 4,829,628 | A * | 5/1989 | Vuksic | 16/54 |
| 4,893,522 | A | 1/1990 | Arakawa | |

(Continued)

FOREIGN PATENT DOCUMENTS

| | | | |
|---|---|---|---|
| CN | 1888364 | A * | 1/2007 |
| DE | 298 08 910 | U1 | 5/1998 |

(Continued)

*Primary Examiner* — Victor Batson
*Assistant Examiner* — Jason W San
(74) *Attorney, Agent, or Firm* — Hiscock & Barclay, LLP

(57) ABSTRACT

A rotary hinge assembly includes a hinge housing including at least one interior chamber. A spring disposed within the hinge housing provides a torque on an attached door while in an opened and closed position. A rotor rotatably disposed within the at least one interior chamber includes at least one rotor vane that moves in relation to a stationarily mounted stator having at least one stator vane. A fill plug includes a plurality of entrance and exit holes disposed in relation to the stator and rotor vanes to define a fluidic damper assembly. A valve disposed within the fill plug permits selective adjustment of the fluidic damper by restricting or opening the entrance and exit holes of the fill plug.

10 Claims, 9 Drawing Sheets

(56) References Cited

U.S. PATENT DOCUMENTS

| | | | | |
|---|---|---|---|---|
| 5,035,455 | A | 7/1991 | Kurosaki | |
| 5,064,033 | A | 11/1991 | Koike et al. | |
| 5,109,571 | A * | 5/1992 | Ohshima et al. | 16/307 |
| 5,153,946 | A * | 10/1992 | Yoke et al. | 4/248 |
| 5,253,391 | A | 10/1993 | Ojima | |
| 5,572,768 | A * | 11/1996 | Daul | 16/49 |
| 5,664,286 | A * | 9/1997 | Sorimachi | 16/54 |
| 5,810,129 | A | 9/1998 | Hanawa et al. | |
| 5,855,040 | A * | 1/1999 | Lin | 16/50 |
| 5,867,866 | A * | 2/1999 | Chen et al. | 16/50 |
| 5,954,167 | A | 9/1999 | Richardson et al. | |
| 5,988,329 | A | 11/1999 | Evans, Jr. et al. | |
| 6,098,765 | A | 8/2000 | Kato et al. | |
| 6,164,592 | A * | 12/2000 | Stephan et al. | 244/118.1 |
| 6,182,301 | B1 * | 2/2001 | Krueger et al. | 4/248 |
| 6,457,207 | B1 * | 10/2002 | Horberg | 16/50 |
| 6,658,694 | B2 * | 12/2003 | Wang | 16/50 |
| 6,687,921 | B1 * | 2/2004 | Li | 4/236 |
| 6,729,448 | B2 * | 5/2004 | Takahashi | 188/294 |
| 6,840,356 | B2 * | 1/2005 | Nishiyama | 188/306 |
| 6,854,161 | B2 | 2/2005 | Lee | |
| 6,886,221 | B2 * | 5/2005 | Minami et al. | 16/324 |
| 6,913,125 | B2 * | 7/2005 | Hayashi | 188/290 |
| 7,066,308 | B2 | 6/2006 | Kanno et al. | |
| 7,210,199 | B2 * | 5/2007 | Clark | 16/299 |
| 7,228,596 | B2 * | 6/2007 | Kang | 16/330 |
| 7,278,522 | B2 | 10/2007 | Reinhardt et al. | |
| 7,322,450 | B2 * | 1/2008 | Orita | 188/296 |
| 7,434,296 | B2 * | 10/2008 | Kubota | 16/330 |
| 7,631,397 | B2 * | 12/2009 | Yin et al. | 16/330 |
| 7,712,186 | B2 * | 5/2010 | Kang | 16/330 |
| 7,810,214 | B2 * | 10/2010 | Feng et al. | 16/348 |
| 7,836,550 | B2 * | 11/2010 | Lin | 16/303 |
| 7,895,710 | B2 * | 3/2011 | Takagi et al. | 16/330 |
| 7,966,693 | B2 * | 6/2011 | Choi et al. | 16/54 |
| 7,966,696 | B2 * | 6/2011 | Krammer | 16/286 |
| 7,971,318 | B2 * | 7/2011 | Kim et al. | 16/330 |
| 8,079,115 | B2 * | 12/2011 | Zhang et al. | 16/326 |
| 8,096,393 | B2 * | 1/2012 | Saito et al. | 188/290 |
| 8,186,014 | B2 * | 5/2012 | Pecar et al. | 16/286 |
| 8,191,206 | B1 * | 6/2012 | Bacchetti | 16/378 |
| 8,245,353 | B2 * | 8/2012 | Homner et al. | 16/299 |
| 8,261,894 | B2 * | 9/2012 | Kanno et al. | 188/290 |
| 8,266,764 | B2 * | 9/2012 | Costabel et al. | 16/54 |
| 8,516,657 | B2 * | 8/2013 | Yoshida | 16/50 |
| 2002/0078529 | A1 | 6/2002 | Schwarz | |
| 2003/0150678 | A1 * | 8/2003 | Iwashita | 188/296 |
| 2003/0204935 | A1 * | 11/2003 | Kim | 16/280 |
| 2003/0234145 | A1 * | 12/2003 | Iwashita | 188/290 |
| 2004/0250377 | A1 * | 12/2004 | Park | 16/50 |
| 2004/0256390 | A1 * | 12/2004 | Nam et al. | 220/264 |
| 2005/0044661 | A1 * | 3/2005 | Cho | 16/76 |
| 2005/0203639 | A1 * | 9/2005 | Wild | 623/44 |
| 2005/0205370 | A1 * | 9/2005 | Kanno et al. | 188/290 |
| 2006/0050867 | A1 | 3/2006 | Kawamoto | |
| 2006/0130276 | A1 * | 6/2006 | Clark | 16/299 |
| 2006/0156458 | A1 * | 7/2006 | Myers | 4/234 |
| 2009/0151121 | A1 * | 6/2009 | Lin | 16/321 |
| 2009/0265889 | A1 * | 10/2009 | Pan | 16/308 |
| 2010/0050385 | A1 * | 3/2010 | Zhang et al. | 16/303 |
| 2010/0205774 | A1 * | 8/2010 | Yoshida | 16/250 |
| 2010/0269294 | A1 * | 10/2010 | Krammer | 16/308 |
| 2010/0300819 | A1 | 12/2010 | Hiemenz et al. | |
| 2011/0041285 | A1 * | 2/2011 | Hong | 16/54 |
| 2011/0048878 | A1 * | 3/2011 | Kanno et al. | 188/290 |
| 2012/0005860 | A1 * | 1/2012 | Chen | 16/305 |
| 2012/0079901 | A1 * | 4/2012 | Shu | 74/89.14 |
| 2013/0247330 | A1 * | 9/2013 | Daul et al. | 16/319 |

FOREIGN PATENT DOCUMENTS

| | | | | |
|---|---|---|---|---|
| DE | 29808910 | U1 | * | 8/1998 |
| DE | 200 21 956 | U1 | | 12/2000 |
| DE | 29825002 | U1 | * | 4/2004 |
| DE | 102006019548 | | * | 11/2007 |
| EP | 251972 | A | * | 1/1988 |
| EP | 1342875 | A1 | * | 9/2003 |
| FR | 2485609 | A | * | 12/1981 |
| GB | 534018 | | | 10/1938 |
| GB | 2420587 | A | * | 5/2006 |
| JP | 11030072 | A | * | 2/1999 |
| JP | 2003214474 | A | * | 7/2003 |
| KR | 2003074566 | A | * | 9/2003 |
| KR | 874633 | B1 | * | 12/2008 |
| WO | WO 9112760 | A | * | 9/1991 |
| WO | WO 0242590 | A1 | * | 5/2002 |
| WO | WO 2007013776 | A1 | * | 2/2007 |
| WO | WO 2008018720 | A1 | * | 2/2008 |
| WO | WO 2008050989 | A1 | * | 5/2008 |
| WO | WO 2009044910 | A1 | * | 4/2009 |

* cited by examiner

ROTARY HINGE WITH ADJUSTABLE DAMPING ASSEMBLY

TECHNICAL FIELD

This application relates generally to the field of hinge assemblies and more specifically to an adjustable fluidic damper for a rotary hinge assembly, such as used in connection with stowage bin door mechanisms for commercial aircraft cabins.

BACKGROUND AND SUMMARY

Stowage bin assemblies, such as those found in passenger cabins on commercial aircraft include mechanisms that utilize a rotary hinge assembly linking the bin door and the stowage bin. The hinge assembly includes a torsion spring that is torqued to move the stowage bin door from a closed position to an open position. Several airlines include different door assemblies involving doors of various weights and sizes. Utilizing a single or universal rotary hinge assembly can therefore produce variations in terms of the opening time of the door, based on weight and geometry of the attached stowage bin door. That is, the rotary hinge assembly will open faster based on a light weight stowage bin door as opposed to a heavier stowage bin door.

There is a general desire in the field to be able to adjustably compensate a rotary hinge assembly based on the weight and geometry of the stowage bin door in order to prevent the door from opening too abruptly or too slowly.

Therefore and according to one aspect of this application, there is provided an adjustable damper for a rotary hinge assembly utilized for opening and holding open a stowage bin door, said hinge assembly comprising:

- a hinge housing including at least one interior chamber;
- a rotor rotatably disposed within said at least one interior chamber of said hinge housing, said rotor including at least one movable rotor vane;
- a stator stationarily disposed within said at least one interior chamber of said hinge housing, said stator including at least one stator vane, said rotor and said stator combining to foam a fluidic damper;
- a fill plug, a portion of said fill plug being disposed between said rotor and stator vanes and including entrance and exit holes for damping fluid defining a fluidic path for said damper;
- an adjustable valve for varying the resistance of the fluidic damper; and
- a spring means disposed within said at least one interior chamber of said hinge housing for biasing the stowage bin door from a closed position to an open position.

In one version and in the adjustable damper portion of the rotary hinge assembly, there are two sets of vanes. A set of stator vanes are stationarily disposed while a set of corresponding rotor vanes are caused to rotate in relation to the stator vanes when the stowage bin door is opened or closed. Running the length of the vanes along a center axis of the rotary hinge assembly is the fill plug wherein damping fluid is metered between the sets of vanes. As noted, the fill plug includes a set of entrance holes and exit holes defining a fluidic path for the damper. As the rotor vanes rotate towards the stator vanes, damping fluid is pressurized and thus moved from one side of the rotor vanes to the other side by traveling through the entrance holes to the exit holes of the fill plug. Preferably, the valve is disposed in the center of the fill plug, the valve being adjustable to open, close or otherwise restrict the flow of damping fluid by selectively either opening or restricting at least a portion of the entrance and exit holes of the fill plug.

In one version, the adjustable valve is defined by a movable pin that is disposed within a center bore of the fill plug, the pin being movable so as to selectively open and close at least a portion of the entrance and exit holes of the fill plug.

According to another aspect of this application, there is provided a method for adjustably damping a rotary hinge assembly, said method comprising the steps of:

- providing a rotor having rotor vanes;
- providing a stator having stator vanes;
- moving the rotor relative to the stator in which a retained fluid is moved from one side of said rotor vanes to the other;
- providing a fill plug having entrance and exit holes within said fill plug and extending between said rotor vanes and said stator vanes, said entrance and exit holes defining a fluidic path; and
- selectively adjusting the size of said entrance and exit holes of said fill plug.

According to one version, an adjustable valve is provided to perform the selective adjustment step. The adjustable valve can, for example, be provided in the form of a movable or adjustable pin that is rotatably disposed within a recess provided in the fill plug.

The fill plug rotates with the rotor according to one version of the hinge assembly in which a plug member is further included that provides a sealing function and defines a fluidic damping chamber, the plug member being sealingly attached to said rotary hinge assembly and retaining the fill plug. The plug member includes an axial opening that permits a user to access the movable pin and permits adjustment of the damper without requiring disassembly of the herein described rotary hinge assembly.

One advantage that is realized by the present invention is that the torque variation acting on the rotary hinge assembly from the weight and geometry differences of a hinged bin door can effectively be compensated for through the adjustable damping feature of the rotary hinge assembly.

Another advantage provided is that any adjustments can easily be made to the rotary hinge assembly without requiring disassembly or modifications.

Yet another advantage provided is that the operating life of the hinge can be extended in use by adjusting the damping to compensate for wear of components over time in use.

These and other advantages and features will become readily apparent from the following Detailed Description, which should be read in conjunction with the accompanying drawings.

DETAILED DESCRIPTION

The following description relates to an exemplary embodiment of an adjustable damper or damping portion for a rotary hinge damping assembly and more particularly for use with a stowage bin assembly used, for example, in the passenger cabins of commercial aircraft. It will be understood, however, that the herein described inventive concepts can be suitably utilized for other purposes and applications. It will also be readily apparent that various modifications and variations would be contemplated as within the ordinary skill of one in the field and not limited to the exemplary embodiment that is described herein. In addition, various terms are used throughout the course of the following discussion, including "top", "bottom", "inner", "outer", "distal", "proximal", "interior", "exterior", "inner", "outer" and the like. These terms are used in order to provide a suitable frame of reference in regard to the accompanying drawings and should not be regarded as overly limiting, however, except where so specifically indicated herein.

Figure 1:
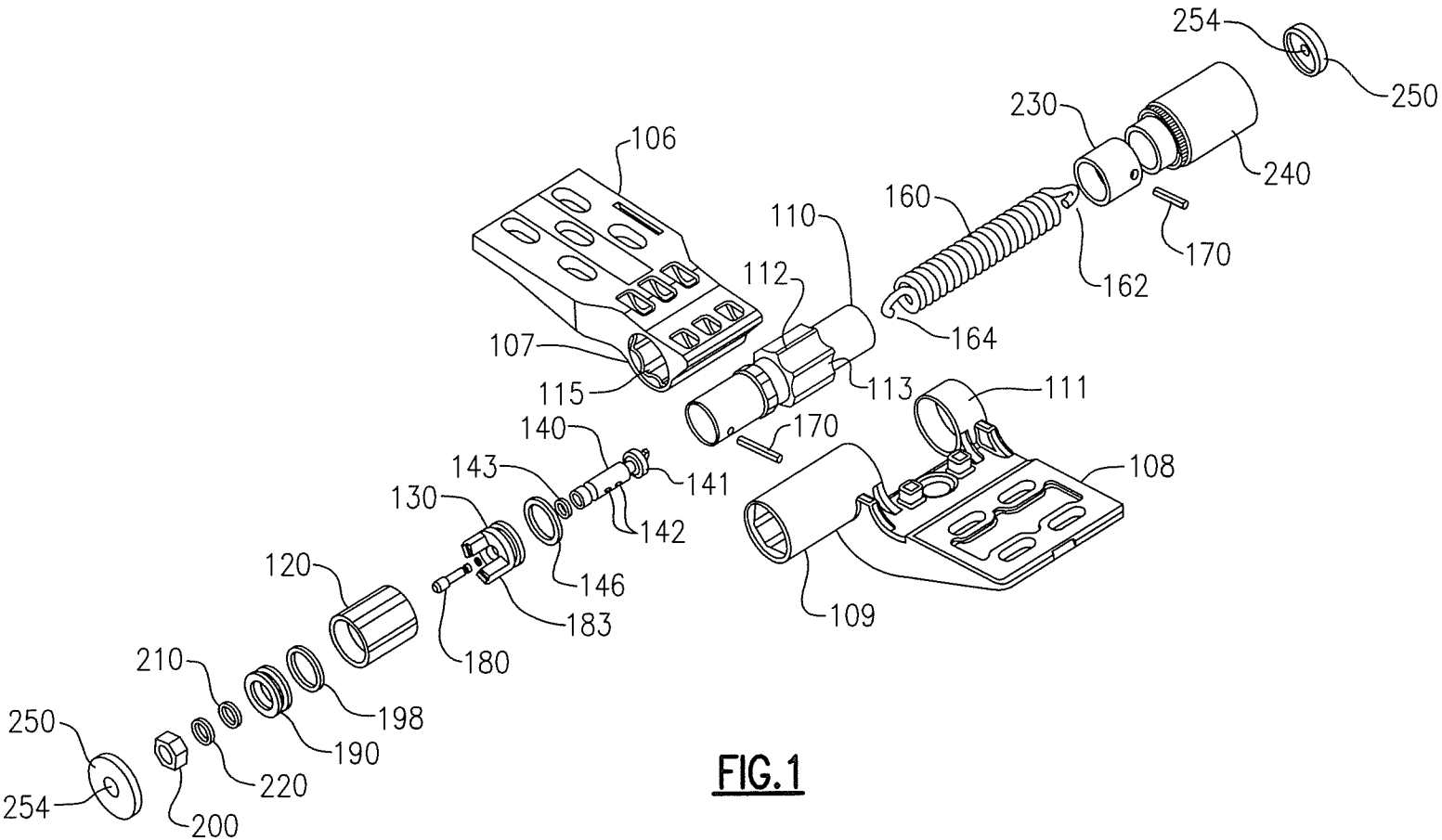
FIG. 1 is an exploded view of a rotary hinge assembly having an adjustable damping portion, which is made in accordance with one aspect.
Figure 2:
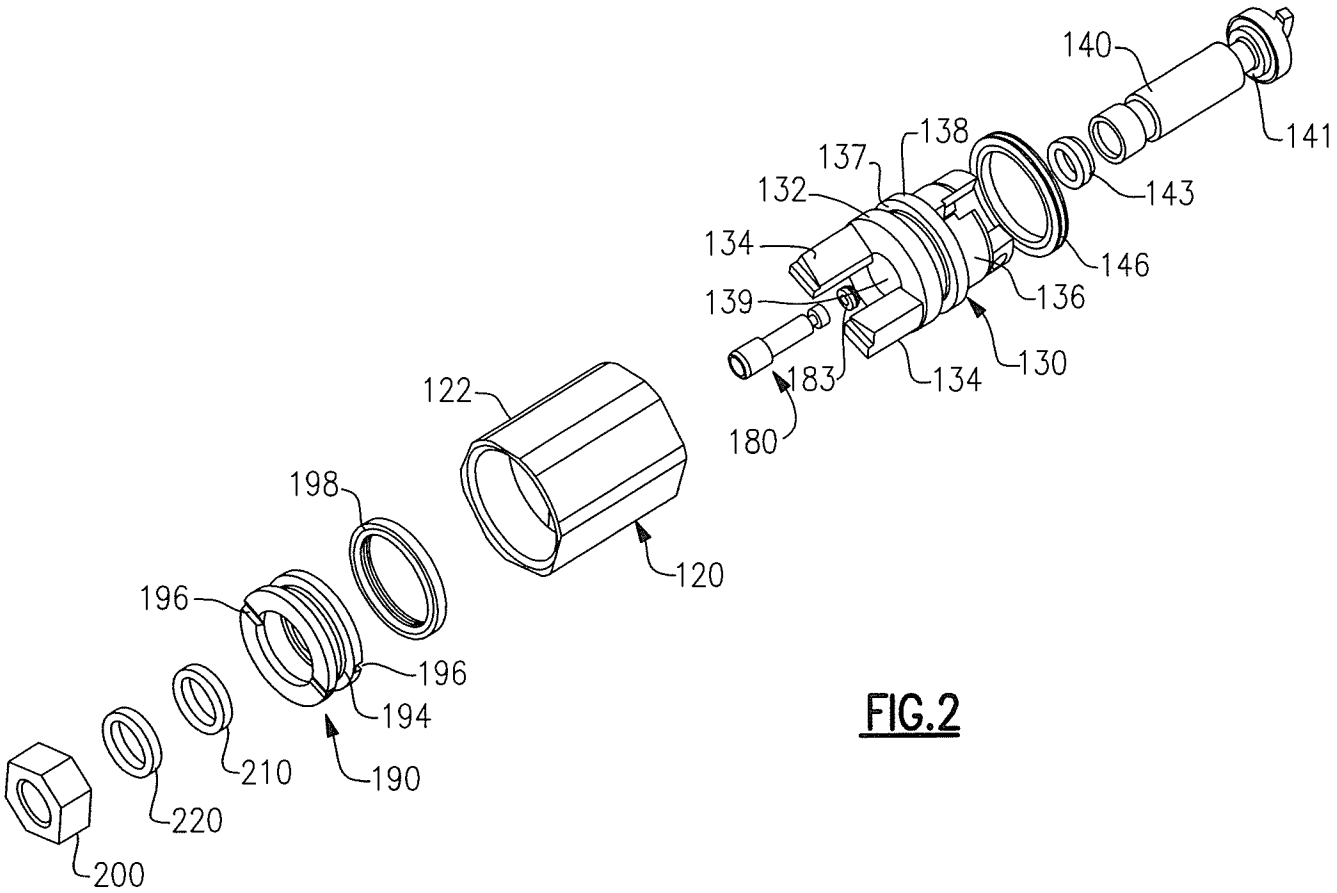
FIG. 2 is an enlarged portion of the exploded view of the adjustable damping portion of the rotary hinge assembly depicted according to FIG. 1.
Figure 3:
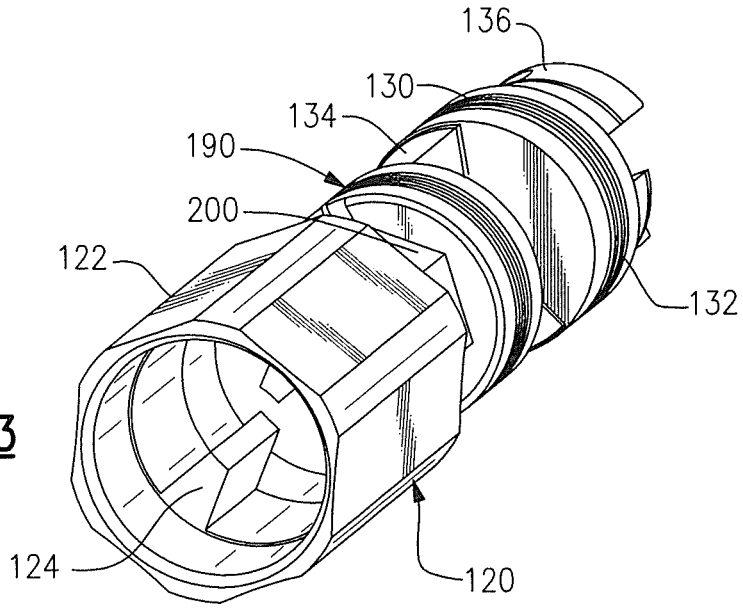
FIG. 3 is a partially assembled perspective view of the adjustable damping portion of the rotary hinge assembly of FIGS. 1 and 2.
Figure 4:
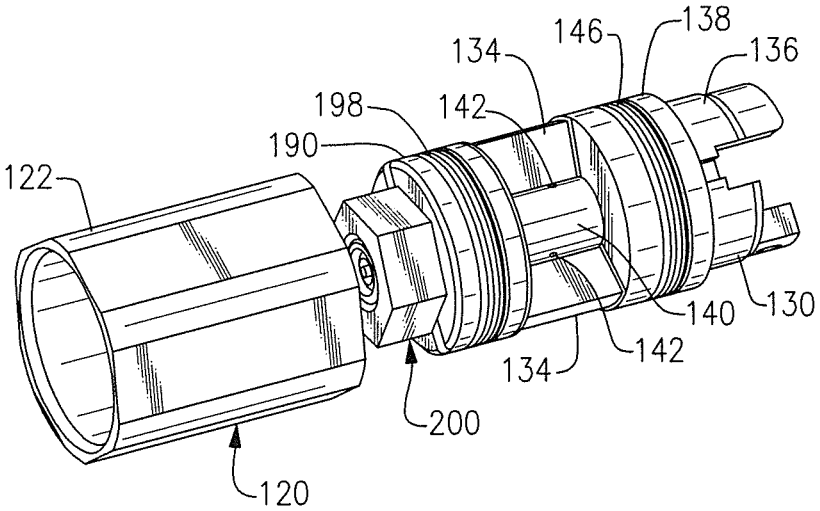
FIG. 4 is a partially assembled side perspective view of the adjustable damping portion of the rotary hinge assembly, including a rotor/stator combination.
Figure 5:
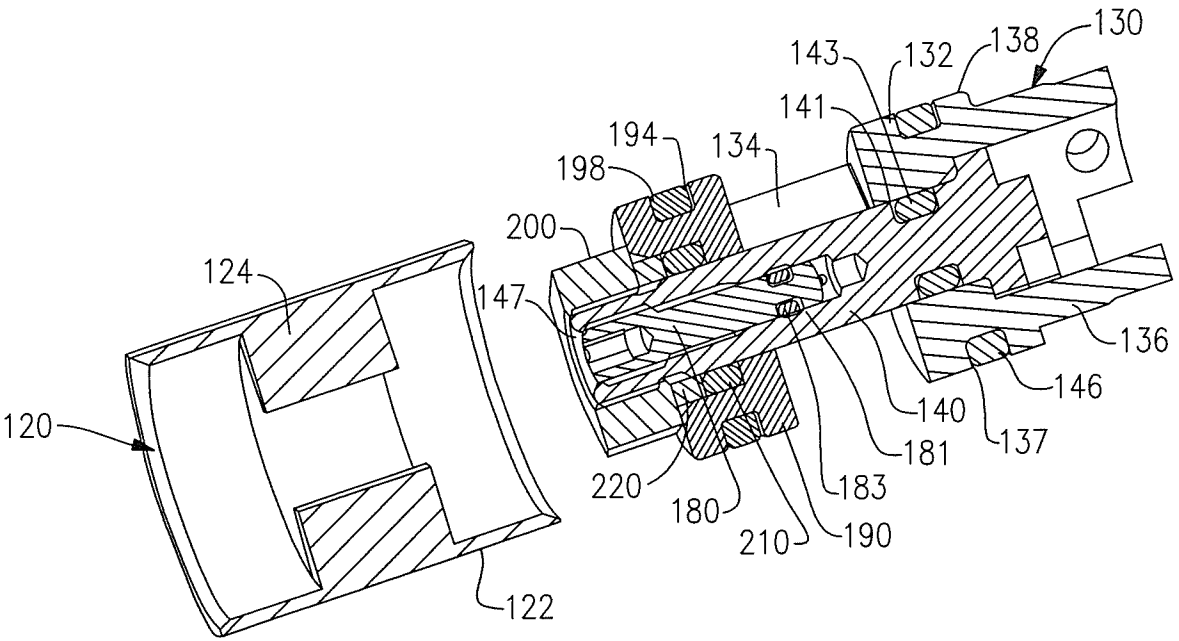
FIG. 5 is the partially assembled side perspective view of the adjustable damper portion of the rotary hinge assembly of FIG. 4, shown sectioned.
Figure 6:
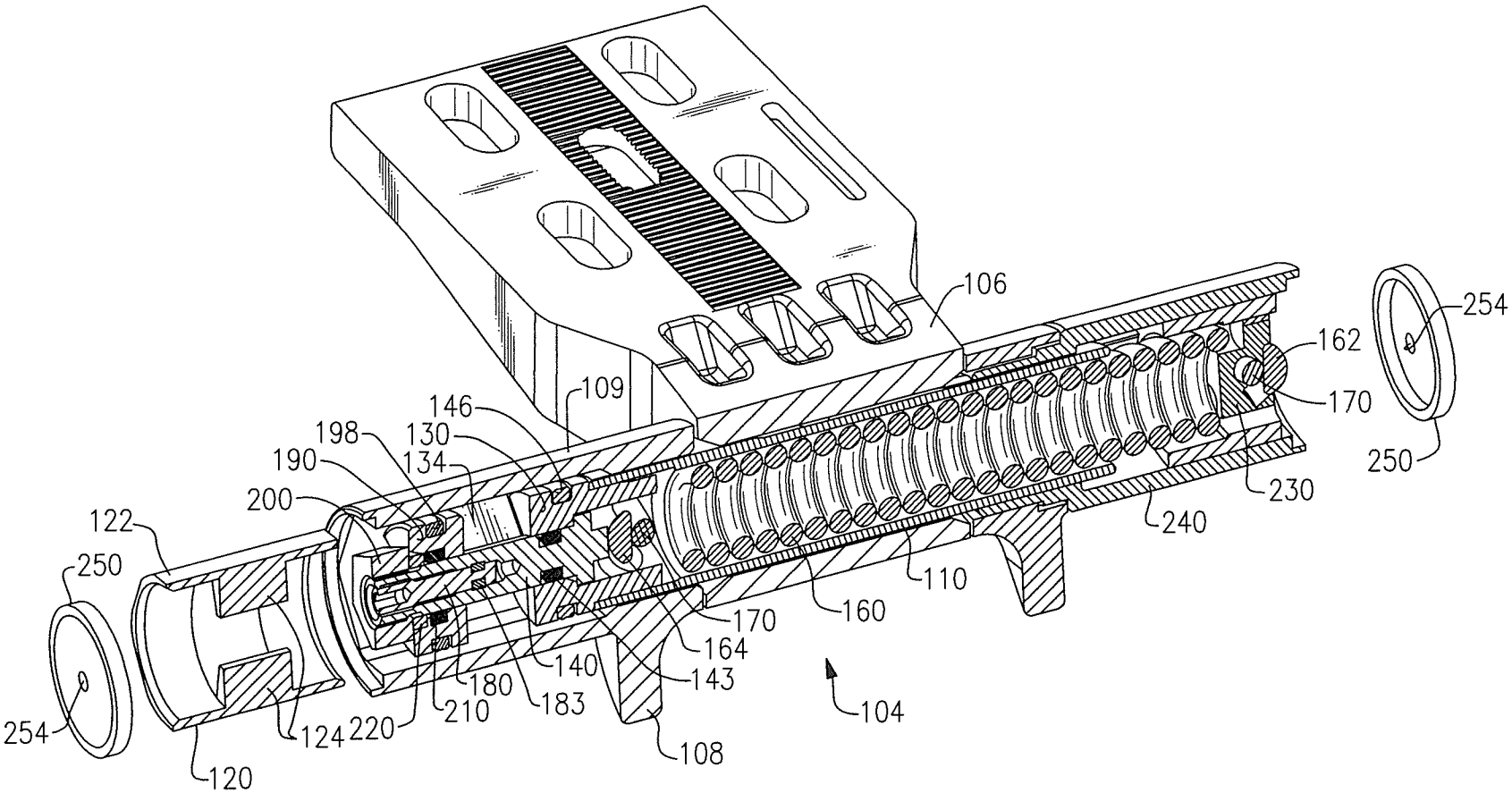
FIG. 6 is a side sectioned view of the assembled rotary hinge assembly, including the adjustable damping portion of FIGS. 1-5, with the stator and end caps exploded.

Referring to FIG. 1, there is shown in exploded form a rotary hinge assembly 100 in accordance with the exemplary embodiment, the assembly including a hinge housing 104, FIG. 6, having two mating hinge half assemblies 106, 108 that are fixedly attached to a stowage bin door and stowage bin of an aircraft (not shown), respectively, using appropriate fasteners (not shown). The complementary door hinge half assembly 106 includes a center cylindrical mating portion 107 that when assembled to the stowage bin hinge half assembly 108 is received between two aligned end cylindrical mating portions 109, 111 thereof. Each of the cylindrical mating portions 107, 109, 111 are hollow and sized to receive a hollow cylinder element 110. The cylinder element 110 includes a center axial portion 112 having a hexagonally shaped exterior surface 113 that is shaped for fixed engagement with a corresponding hex-shaped opening 115 foamed in the hollow cylindrical mating portion 107 of the door hinge half assembly 106. The stowage bin door (not shown), along with the attached hinge half assembly 106 and cylindrical mating portion 107 will therefore rotate when opened and closed about an axis defined by the cylinder element 110 while the remaining hinge half assembly 108 is stationary, including mating portions 109, 111. The cylindrical mating portions 107, 109, 111 and the cylinder element 110 combine to define an interior chamber for the hinge housing 104, which is suitably sized to retain a number of retained components including those of an adjustable damping portion of the herein described rotary hinge assembly 100, as described in a later portion.

The hinge housing 104 and more particularly the cylinder element 110 retains an axial portion of a torsion spring 160, with the proximal end 162 of the torsion spring being disposed within a spring retainer 230 and secured thereto by a transversely mounted groove pin 170. The spring retainer 230 is further secured from rotation to a spring sleeve 240, which is utilized to torque the torsion spring 160 and then fix the spring to the end cylindrical mating portion 111 to prevent rotation. The remaining or distal end 164 of the torsion spring 160 is similarly secured to the rotor 130 and cylinder element 110 by another transverse groove pin 170, relative to the adjustable damping portion of the rotary hinge assembly 100, which is now discussed in greater detail.

The adjustable damping portion of the rotary hinge assembly 100 according to this embodiment includes the following components; namely, a stationarily mounted stator 120, a rotor 130 mounted for rotation, a fill plug 140, an adjustable valve 180 and a plug 190. Each of these components will be separately discussed prior to a discussion of the overall operation of the rotary hinge assembly 100, including that of the adjustable damping portion.

The stator 120 and rotor 130 according to this exemplary embodiment are depicted in greater detail in FIGS. 2-6. More specifically, the stator 120 is defined by a substantially cylindrical member or body 122. The exterior surface of the stator body 122 is defined by a hexagonally shaped periphery that is fitted within a correspondingly shaped opening of the end cylindrical mating portion 109 of the stowage bin hinge half assembly 108. Since the attached stowage bin (not shown), including the cylindrical mating portions 109, 111 remain stationary in use, the stator 120 is therefore fixedly retained in this assembly 100. The interior of the stator body 122 is hollow with the exception of a pair of diametrically opposed stator vanes 124 that radially extend inwardly from an interior surface. The stator vanes 124 are disposed at an intermediate axial portion of the stator body 122, wherein the specific number of vanes that are required can be varied accordingly. That is, at least one stator vane 124 is required.

Still referring to FIGS. 2-6, the rotor 130 is defined by a substantially cylindrical rotor body 132 that includes a proximal extending portion 136, the latter of which is positioned to extend within a distal end of the cylinder element 110, as shown most particularly in FIG. 6. The proximal extending portion 136 includes an abutting shoulder 138 defined by a circumferential wall that includes a lateral opening which is sized for receiving the transverse groove pin 170 used for retaining the distal end 164 of the torsion spring 160. An annular recess or groove 137 provided on the exterior circumferential surface of the rotor body 132 is sized to accommodate an elastomeric seal ring 146, in order to create a fluid tight seal for a damping chamber 150 that is defined by the stator 120 and rotor 130, when assembled and as discussed in greater detail subsequently. The distal end of the rotor 130 includes a pair of rotor vanes 134, each vane defined as a distal extension of the rotor body 132 and radially disposed outboard from a center opening 139 axially extending through the rotor body. According to this embodiment, each rotor vane 134 is defined by an outer surface that is substantially coplanar with the exterior surface of the rotor body 132, an interior radial surface as well as opposing lateral surfaces which are angled to define a vane configuration. The number of rotor vanes can also be varied, provided at least one said vane is provided.

The fill plug 140 is an elongate substantially cylindrically shaped member made from a fluid impermeable material having a hollow interior, as well as a plurality of circumferentially disposed entrance and exit holes 142. According to this exemplary embodiment, four (4) holes 142 are provided (only two of which are visible in FIG. 4), each hole extending into the hollow interior of the fill plug 140, the holes being staggered axially along an intermediate axial portion of the till plug and extending into a narrowed proximal end of a center bore extending to the distal end of the fill plug. The space occupied by the rotor vanes 134, the stator vanes 124, the plug 190, and the intermediate axial portion of the fill plug 140, including the entrance and exit holes 142 thereof, combine to define the damping chamber 150. An elastomeric ring 143 is disposed within a groove 141 formed in the proximal end of the till plug 140 to create a seal. In assembly, the proximal portion of the fill plug 140 is retained within the rotor 130 while the remainder of the fill plug axially extends outwardly through the center opening 139 of the rotor, between the rotor vanes 134 and into the interior of the plug 190. The fill plug is restrained from distal axial movement by means of the proximal end surface of the rotor body 132. When assembled, the fill plug 140 is disposed to rotate along with the rotor 130 when the stowage bin door (not shown) of the mechanism is opened and closed, as discussed in greater detail below.

The plug 190 is a substantially cylindrically shaped hollow component having a pair of axial grooves 196 that are sized to accommodate the distal ends of the rotor vanes 134 so as to retain the plug 190 to the rotor 130 so that both components rotate as the stowage bin door (not shown) is opened and closed. An annular groove 194 formed on the exterior circumference of the plug 190 retains a sealing ring 198 that engages the interior surface of the stator 120 and creates a fluid tight seal to prevent fluid from passing therethrough and defining the distal side of the defined damping chamber 150. As most clearly shown in FIG. 6, a threaded nut 200 and washer 220 are assembled to the distal side of the plug 190. A seal ring 210 is disposed between the exterior surface of the fill plug 140 and the interior surface of the plug 190 to provide a fluid tight seal, the seal ring being fitted into an annular recess 151 defined in the plug 190. The adjustment valve 180, which according to this embodiment is an adjustable pin element, is axially disposed within the distal end of the fill plug 140 and more specifically within the center bore 147.

As noted, the fill plug 140 includes respective pairs of entrance holes and exit holes 142 defining a fluidic path. When assembled, the rotor vanes 134, the portion of the stator 120 having the stator vanes 124, the plug 190, and the intermediate axial portion of the fill plug 140 having the entrance and exit holes 142 combine to define the damping chamber 150. Fluidic seals are provided by the seal rings 146 and 198 on opposing sides of the defined chamber 150 between the rotor body 132 and plug 190 and the interior surface of the stator 120, respectively. Interior fluidic seals are further created by the seal ring 210 in the plug 190 between the interior of the plug 190 and the exterior of the fill plug 140, and the seal ring 143 disposed within the groove 141 provided within the proximal end of the fill plug 140, creating a seal between the interior of the rotor body 132 and the exterior of the fill plug 140, and a seal ring 183 provided in a groove 181 formed in the adjustable valve 180 creating a seal between the adjustable valve 180 and the center bore 147 of the fill plug 140.

In brief, the rotor 130 is caused to move rotationally depending on the position of the bin door (not shown) relative to the stowage bin (not shown) based on corresponding rotation of the hinge, thereby creating relative movement between the stationary stator vanes 124 and the rotor vanes 134 to produce pressure in and thus movement of fluid contained within the damping chamber 150 about the vanes and through the fluidic paths established by the entrance and exit holes 142 of the fill plug 140. The adjustable valve 180 by way of rotation within the center bore 147 of the fill plug 140 can further restrict or permit fluid flow between the entrance and exit holes 142 of the defined damping chamber 150. As noted and according to this embodiment, the adjustable valve 180 is a movable pin element having a distal end that includes a feature 185 that is accessible by means of an Allen wrench or similar tool to permit the pin to be rotated within the center bore 147.

In operation and referring to the Figures, the opening and closing of the stowage bin door (not shown) causes relative movement of the retained components. A quantity of damping fluid is retained by the rotary hinge assembly 100 within the defined damping chamber 150. In the bin door closed position, the torsion spring 160 is additionally torqued from its initially pretorqued condition when the bin door is open. As the stowage bin door (not shown) is opened, the door hinge assembly 106 is caused to rotate along with the torsion spring 160 and the cylinder element 110, which coacts to rotate the attached rotor 130, fill plug 140 and plug 190 in relation to the stationary stator 120. Therefore and within the defined damping chamber 150, the resulting rotational movement of the rotor vanes 134 relative to the stationary stator vanes 124 causes pressure in the fluid and thus movement of the damping fluid.

Figure 7:
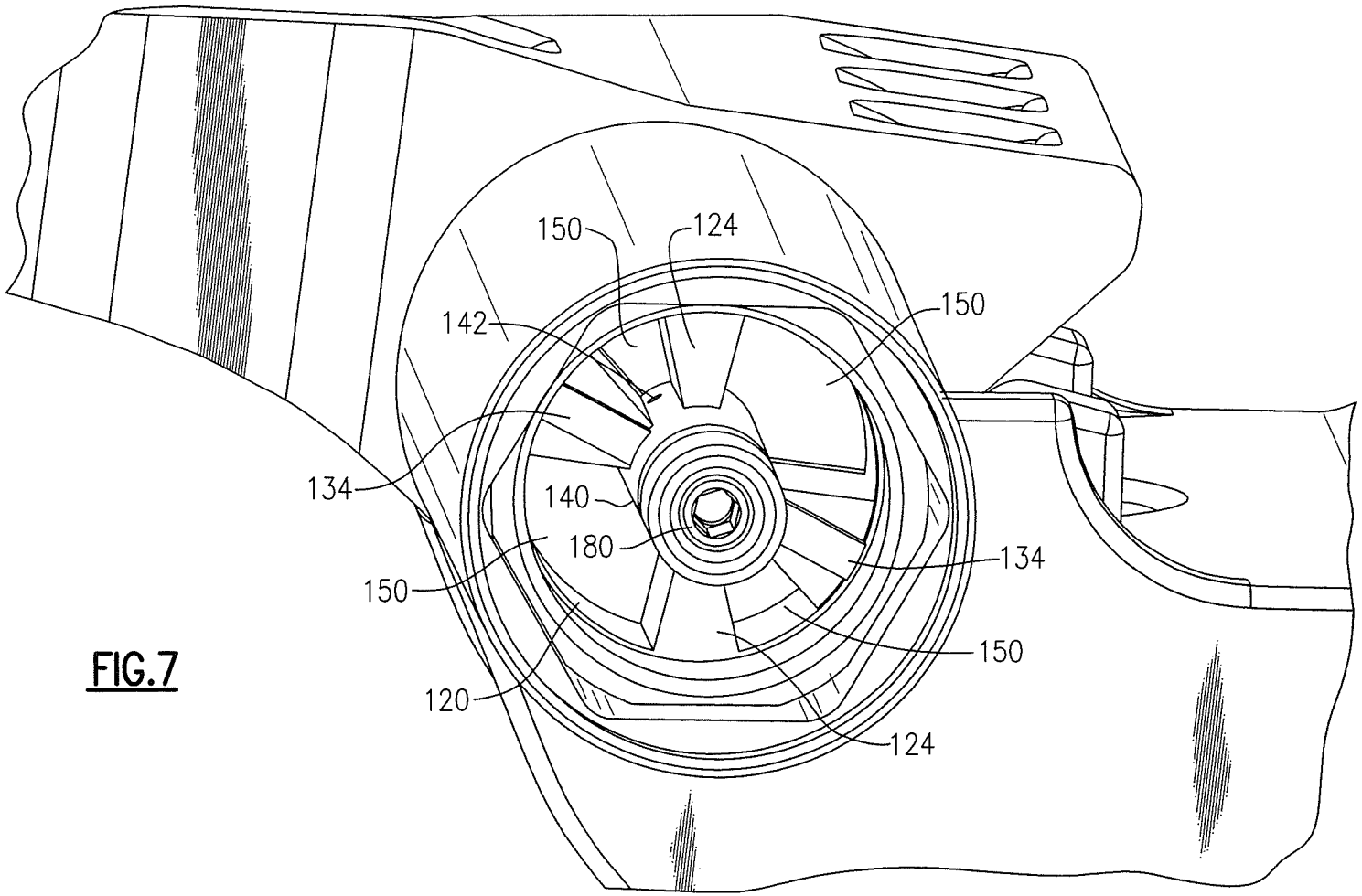
FIG. 7 is an enlarged partial end view of the adjustable damping portion of the rotary hinge assembly, depicting the hinge in the door opened position.
Figure 8:
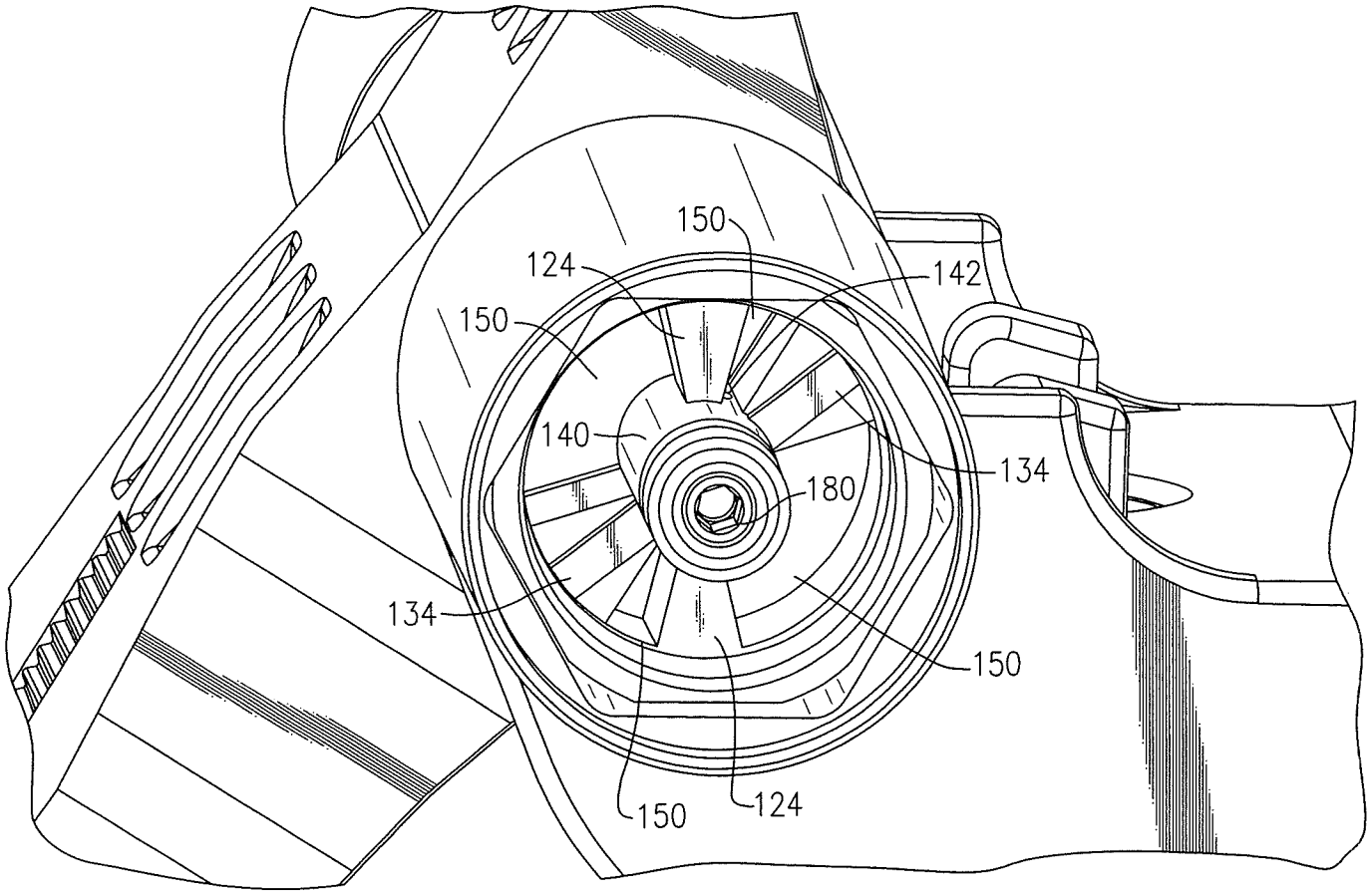
FIG. 8 is the enlarged partial end view of the adjustable damping portion of the rotary hinge assembly according to FIG. 7, depicting the hinge in the door closed position.

Illustratively and referring to FIGS. 7 and 8, views are provided of the defined damping chamber 150. As shown, the disposition of the vanes 124, 134 and the entrance and exit holes 142 of the fill plug 140 create four (4) spaced quadrants that are established through which the fluid is moved based on the rotational movement of the rotor vanes 134 in the defined damping chamber 150. A damping force is therefore produced as fluid is pushed in either rotational direction, including along the fluidic path which is established between the entrance and exit holes 142 of the fill plug 140. As the stowage bin door (not shown) is opened, the preloaded torsion in the torsion spring 160 decreases. In parallel, the damping force caused by the movement of the contained fluid in the defined damping chamber 150 acts to control the opening velocity of the storage bin door.

Figure 9:
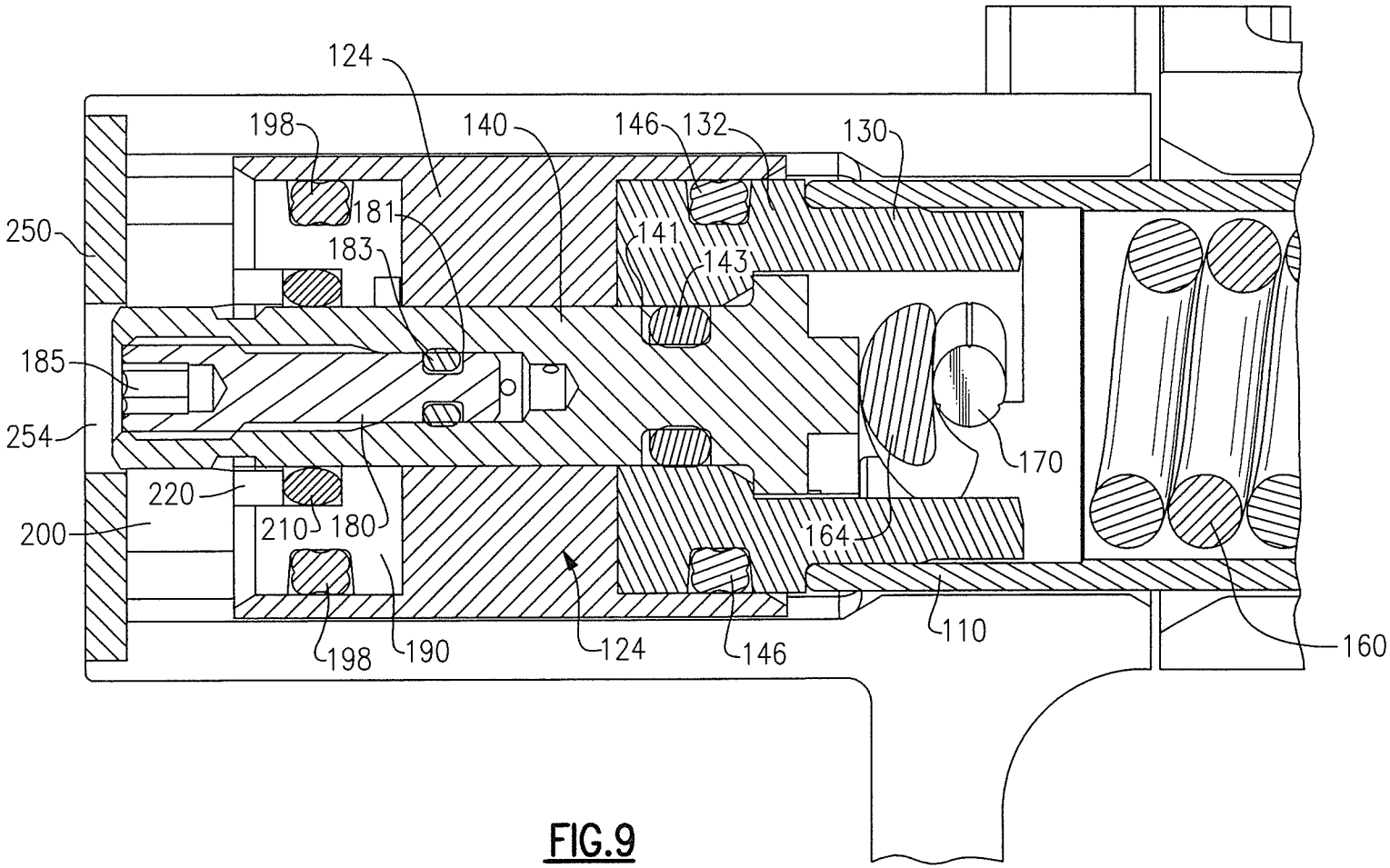
FIG. 9 is a partial side sectioned view of the rotary hinge assembly, partially broken away, illustrating the position of the adjustment valve in the fill plug with the valve in the opened position.
Figure 10:
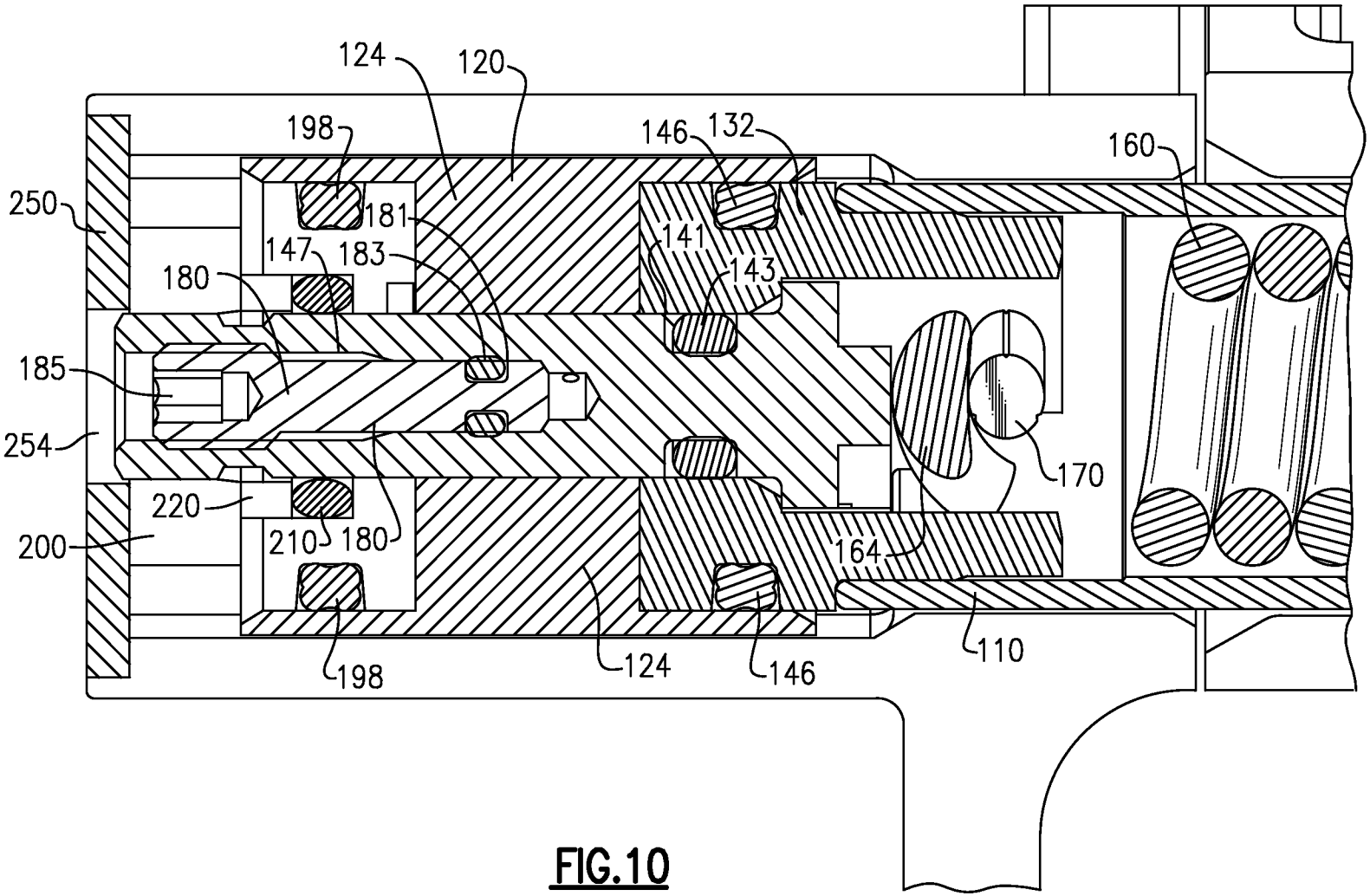
FIG. 10 is a similar partial side sectioned view of the rotary hinge assembly, similar to FIG. 9, illustrating the position of the adjustment valve in the fill plug with the valve in the closed position.

As shown in FIGS. 9 and 10, the adjustable valve 180 can be accessed without requiring disassembly of the herein described hinge assembly 100 to selectively cover any of the entrance and exit holes 142 of the fill plug 140 or a portion thereof so as to affect or adjust the damping force, permitting a consistent opening velocity irrespective of the door weight and geometry. An end cover 250 includes a center opening 254 that is substantially aligned with the head of the adjustable valve 180, enabling access of the feature 185 of the valve by means of an Allen wrench (not shown). The open and closed positions of the adjustable valve 180 are each shown in FIGS. 9 and 10, respectively by which rotation and axial position of the valve enables selective rotational movement of the valve stem having features to block or partially block the entrance and exit holes 142 of the fill plug 140. It will be readily apparent that other suitable valving could alternatively in lieu of the adjustable pin element be used for purposes of this invention. In the meantime and referring to FIGS. 7 and 8, the relative direction of rotation of the rotor vanes 134 relative to the stator vanes 124 enables movement of fluid from one side of the rotor vanes 134 to the other through the entrance and exit holes 142 in the fill plug 140.

PARTS LIST FOR FIGS. 1-10

100 hinge assembly
104 hinge housing
106 hinge half assembly, bin door side
107 center cylindrical mating portion
108 hinge half assembly, stowage bin side
109 end cylindrical mating portion
110 cylinder element
111 end cylindrical mating portion
112 center portion
113 exterior surface, cylinder element
115 hex shaped opening
120 stator
122 stator body
124 stator vanes
130 rotor
132 body, rotor
134 rotor vanes
136 proximal extending portion, rotor
137 annular groove, rotor
138 abutting shoulder, rotor
139 center opening, rotor body
140 fill plug
141 groove
142 entrance and exit holes, fill plug
143 seal ring
146 seal ring
147 center bore
150 damping chamber
151 annular recess
160 torsion spring
162 proximal end, spring
164 distal end, spring
170 groove pin
180 adjustable valve
181 groove
183 seal ring
185 feature
190 plug
194 groove, annular
196 axial grooves
198 seal ring
200 threaded nut
210 seal ring
220 washer
230 spring retainer
240 spring sleeve
250 end cap
254 opening It will be readily apparent that there are numerous variations and modifications that can be made within the spirit and scope of the invention, according to the following claims.

The invention claimed is:

1. A rotary hinge assembly utilized for opening and holding open a storage bin door, said rotary hinge assembly comprising:

a hinge housing including at least one interior chamber;

a rotor rotatably disposed within said at least one interior chamber of said hinge housing, said rotor including a rotor body and at least one rotor vane extending from said rotor body;

a stator stationarily disposed within said at least one interior chamber, said stator including a hollow stator body and at least one stator vane extending inwardly from an inner circumferential wall of said hollow stator body, said rotor and said stator being coxially disposed and configured such that said at least one rotor vane extends within the hollow stator body and coacts with said at least one stator vane when the rotor rotates about a center axis of said hinge housing;

a fill plug, disposed within said hollow stator body and said rotor body and having an extending axial portion that is radially inwardly situated relative to said at least one rotor vane and said at least one stator vane, said fill plug being supported for rotation with said rotor about the center axis of said hinge housing and wherein said extending axial portion of said fill plug includes at least one entrance hole and at least one exit hole disposed in relation to said at least one stator and rotor vanes which combine with the interior of said hollow stator body to define a chamber containing a damping fluid and wherein rotational movement of rotor and said fill plug causes said damping fluid to be pressurized and moved from one side of the at least one rotor vane to an opposite side thereof through the entrance holes to the exit holes of the extending axial portion of said fill plug as a circumferential spacing between the at least one rotor vane and at least one stator vane changes based on the rotation of the rotor and fill plug, and thereby forming a fluidic damper;

an adjustable valve for varying the resistance of the fluidic damper, said adjustable valve being engageable with the fill plug to vary the size of the at least one entrance and exit holes; and at least one spring disposed within said at least one interior chamber of said hinge housing for actuating the bin door from the closed position to the opened position.

2. An apparatus as recited according to claim 1, wherein said at least one spring is an axially disposed torsion spring.

3. An apparatus as recited according to claim 1, wherein said adjustable valve is disposed within a recess defined within said fill plug.

4. An apparatus as recited according to claim 3, wherein said adjustable valve is a movable pin, said pin being movable within said fill plug recess to selectively cover at least a portion of said entrance and exit holes of said fill plug.

5. An apparatus as recited according to claim 4, wherein said movable pin is accessible to a user without disassembly of said rotary hinge assembly.

6. An apparatus as recited according to claim 1, wherein said at least one spring is a torsion spring, said torsion spring being configured to increase in torque when the bin door is moved to the closed position, said torsion spring being connected to said damper.

7. An apparatus as recited according to claim 5, including an end cover having a center opening permitting access to said adjustable pin.

8. A method for adjustably damping a rotary hinge assembly, said method comprising the steps of:

providing a hinge housing having an interior;

providing a rotor having a rotor body and at least one rotor vane;

providing a stator having a hollow stator body and at least one stator vane extending radially inward from an inner circumferential wall of said stator body, said rotor being configured for rotation about a center axis of said hinge housing and in which said rotor is configured for rotation about a center axis of said hinge housing and in which said rotor is coaxially arranged with said stator and positioned such that said at least one rotor vane is disposed within the confines of the hollow stator body and in circumferential relation with said at least on stator vane, said stator being stationarily disposed within said hinge housing;

providing a fill plug disposed within said rotor body along the center axis of said hinge housing and having an extending axial portion extending into said hollow stator body, said fill plug being disposed for rotation with said rotor, said extending axial portion having at least one entrance hole and at least one exit hole wherein said at least one said rotor vane and said at least one stator vane and said entrance and exit holes define a fluidic chamber containing a damping fluid which is caused to move through said fluidic chamber from one side of the at least one rotor vane to an opposite side of the at least one rotor vane as a circumferential spacing between said at least one rotor vane and said at least one stator vane changes upon rotation of said rotor and said fill plug and in which contained fluid is moved using the entrance and exit holes of the fill plug and thereby creating a damper;

providing an adjustable valve for carrying the resistance of the fluidic damper, said adjustable valve being engageable with said fill plug to vary the size of the at least one entrance and exit holes;

selectively adjusting the size of said entrance and exit holes of said fill plug by covering at least a portion of said entrance and exit holes to affect the damping rate of said assembly; and providing a torsion spring as a spring means for said rotary hinge assembly, wherein said damper acts to slow the opening of said rotary hinge assembly.

9. A method as recited according to claim 8, wherein said selectively adjusting step includes said adjustable valve is a pin insertable into a defined recess of said fill plug, said pin being movable within said recess so as to selectively cover at least a portion of at least one of said entrance and exit holes of said fill plug.

10. A method as recited according to claim 9, wherein said rotary hinge assembly includes an end cover, said end cover having an opening permitting access to said adjustable pin without requiring disassembly of said rotary hinge assembly.

* * * * *

UNITED STATES PATENT AND TRADEMARK OFFICE

CERTIFICATE OF CORRECTION

PATENT NO. : 8,745,820 B2
APPLICATION NO. : 13/250268
DATED : June 10, 2014
INVENTOR(S) : John M. Janak It is certified that error appears in the above-identified patent and that said Letters Patent is hereby corrected as shown below:

In the Claims

Column 9
Line 3, please change "on" to --one--

Signed and Sealed this
Twelfth Day of August, 2014

Michelle K. Lee

Michelle K. Lee
*Deputy Director of the United States Patent and Trademark Office*